United States Patent [19]

Springer et al.

[11] Patent Number: 4,805,568

[45] Date of Patent: Feb. 21, 1989

[54] SWING VALVE FOR INTERNAL COMBUSTION ENGINES

[76] Inventors: Joseph E. Springer, 11247 Monte Vista, Ontario, Calif. 91762; James R. Edwards, 4871 W. Howard, Ontario, Calif. 91761

[21] Appl. No.: 19,967

[22] Filed: Feb. 27, 1987

[51] Int. Cl.[4] ..... F01L 1/30; F01L 3/08

[52] U.S. Cl. ..... 123/188 GC; 123/90.25; 123/90.28

[58] Field of Search ..... 123/90.25, 188 GC, 90.29, 123/90.28, 90.44, 188 AP

[56] References Cited

U.S. PATENT DOCUMENTS

| | | | |
|---|---|---|---|
| 1,541,081 | 6/1925 | Vareille | 123/90.25 |
| 2,807,253 | 9/1957 | Etchells | 123/188 GC |
| 3,254,637 | 6/1966 | Durham | 123/90.25 |
| 3,610,218 | 10/1971 | Durham | 123/90.25 |
| 4,309,966 | 1/1982 | Klomp | 123/90.28 |

FOREIGN PATENT DOCUMENTS 111084 6/1918 United Kingdom .

*Primary Examiner*—Andrew M. Dolinar
*Attorney, Agent, or Firm*—Edgar W. Averill, Jr.

[57] ABSTRACT

A valve assembly mounted in the head of an internal combustion engine. The valve is driven on the stem thereof in an arcuate motion so that the valve does not oscillate along its longitudinal axis, but instead swings slightly away from its longitudinal axis during each reciprocation. The valve is preferably driven not only downwardly, but also upwardly to permit a high rate of oscillation.

17 Claims, 3 Drawing Sheets

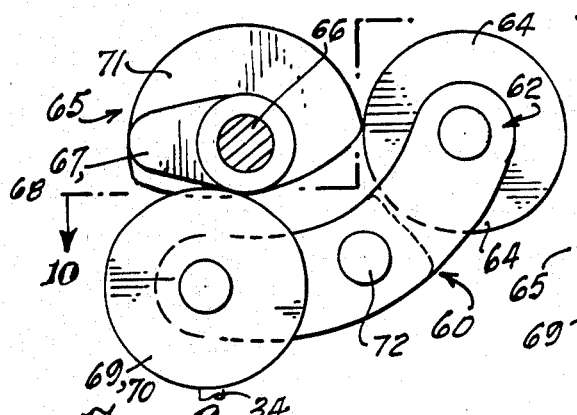
FIG. 9.
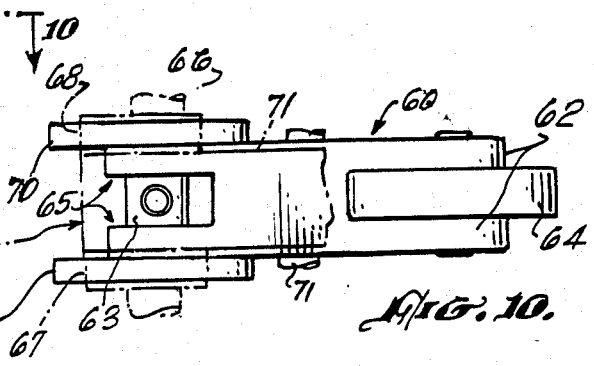
FIG. 10.
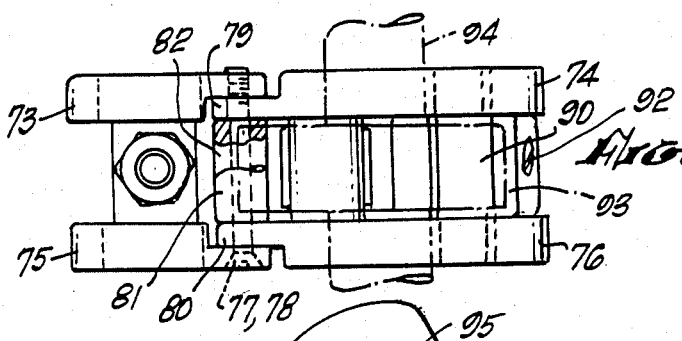
FIG. 7.
FIG. 8.
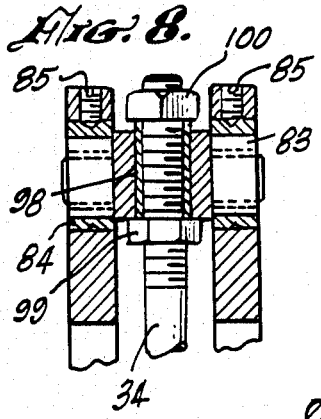
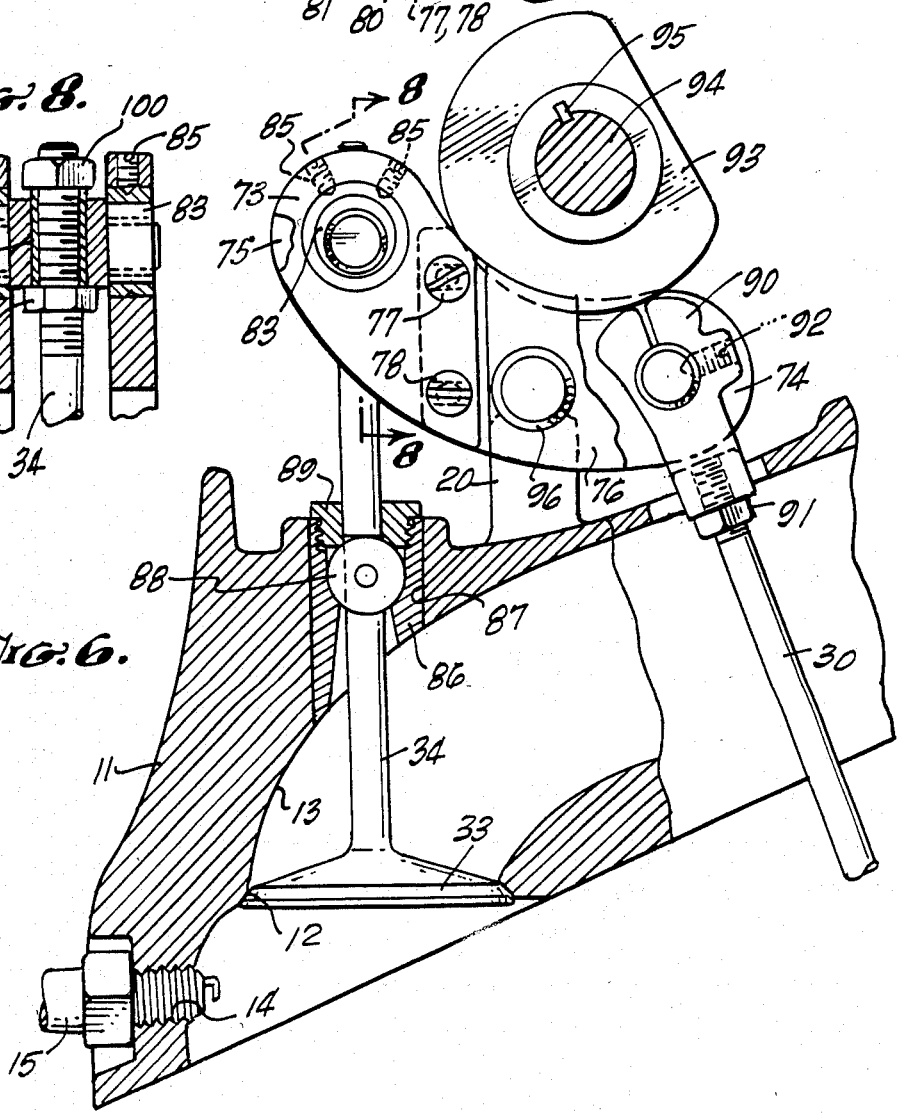
FIG. 6.

SWING VALVE FOR INTERNAL COMBUSTION ENGINES

BACKGROUND OF THE DISCLOSURE

The field of the invention is internal combustion engines and the invention relates more particularly to means for operating the exhaust and intake valves of internal combustion engines.

It is, of course, important that exhaust and intake valves of internal combustion engines move sufficiently away from the valve seat to permit the rapid entry and exhaust of gasses. Invariably, this is provided by a reciprocal longitudinal movement of a valve face away from a valve seat which, of course, provides an annular space through which the gasoline and air vapor enters in the case of an intake valve, and the burned gasses exhaust in the case of an exhaust valve.

The valve assemblies of internal combustion engines which drive the valve in a positive manner, not only during the opening of the valve but also during the closing of the valve, are referred to as desmodromic type valve assemblies. Such assemblies are advantageous particularly for engines operating at high rpms. When the valve must wait for the action of a valve spring to cause it to close, there is inherently an element of inertia which delays the closing of each valve. Various means have been proposed to provide this positive closing action and patents disclosing such action are as follows: U.S. Pat. No. 2,814,283; Italian Pat. No. 563,164; U.S. Pat. Nos. 1,408,781; 1,309,339; 1,238,263; 1,671,973, 1,185,516; 1,503,384; 1,541,081; 3,313,280; 3,254,637; and 3,610,218. Such structures, however, have invariably led to unacceptable wear and except for a few specialized racing engines, such valve assemblies have found no practical widespread use.

SUMMARY OF THE INVENTION

It is an object of the present invention to provide a valve assembly which has a valve face which swings away from the valve seat as it opens.

It is another object of the present invention to provide a valve assembly of the desmodromic type which has a very low order of wear.

The present invention is for a valve assembly mounted in the head of an internal combustion engine including a valve and valve support and opening and closing apparatus. The assembly comprises an engine head including at least one valve seat and a rocker arm held to the head by a bearing. The engine valve which is moved by the rocker arm is supported along its valve stem by a valve guide which permits the nonaxial movement of the valve stem while having a fixed point of movement with which the longitudinal axis of the valve stem always intersects, and said engine valve being affixed to said rocker arm by rocker arm to valve bearing means affixed to the valve stem, which bearing means moves in an arcuate motion about the center of movement of the rocker arm to head bearing means. Means are provided for oscillating the rocker arm about the rocker arm to head bearing means whereby the valve face moves downwardly and sidewardly away from the valve seat as the valve end of the rocker arm moves downwardly and returns to its closed seated position as the valve end of the rocker arm moves to its uppermost position. Preferably, the valve stem is held in a spherical member held in a spherical cavity in the engine head. Preferably, the rocker arm is driven downwardly by a first cam and upwardly by a second cam to provide positive movement in both directions of the valve.

BRIEF DESCRIPTION OF THE DRAWINGS

FIG. 6 is a side view partly in cross section of an alternate embodiment of the valve assembly of FIG. 1.

FIG. 7 is a plan view of the valve assembly of FIG. 6.

FIG. 8 is a cross-sectional view taken along line 8—8 of FIG. 6.

FIG. 9 is a side view of an alternate embodiment of the valve assembly of FIG. 6.

FIG. 10 is a view taken along 10—10 of FIG. 9.

DESCRIPTION OF THE PREFERRED EMBODIMENTS

Figures 1, 2, 5:
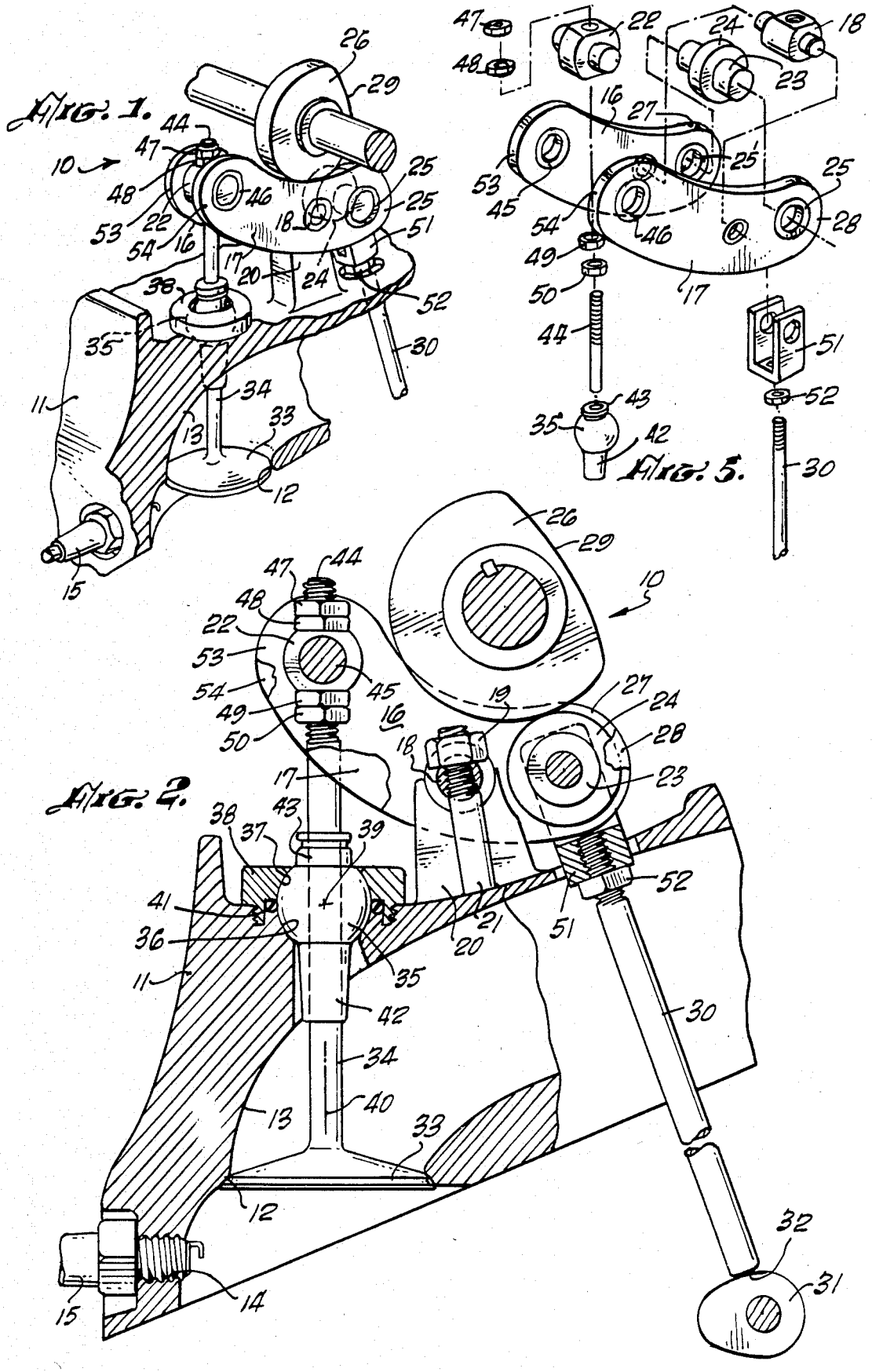
FIG. 1 is a perspective view partially cut away of the valve assembly of the present invention.
FIG. 2 is a cross-sectional side view of the valve assembly of FIG. 1 showing the valve in its closed position.
FIG. 5 is a fragmentary, perspective view of the rocker arm and upper portions of valve rod and pushrod of the valve assembly of FIG. 1.
Figure 4:
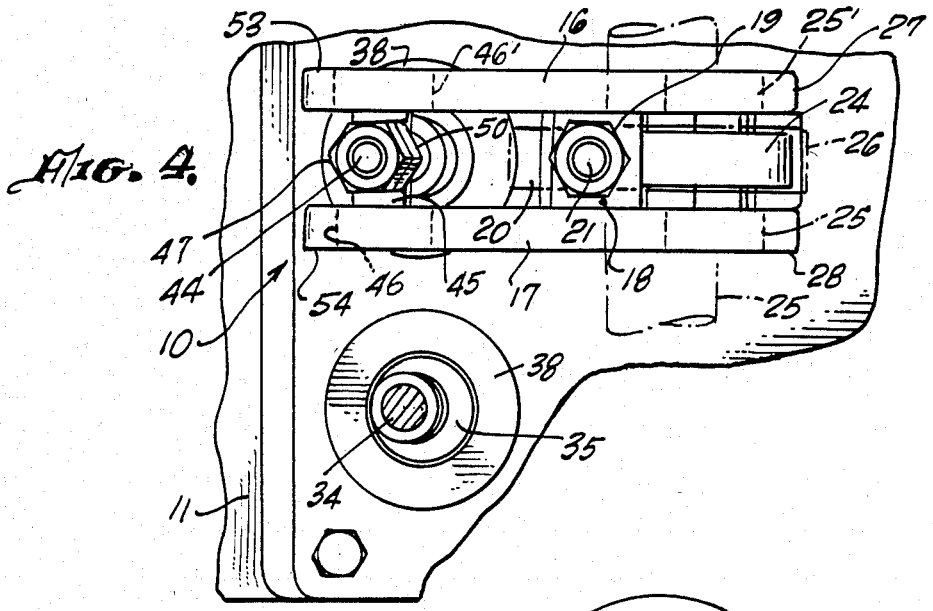
FIG. 4 is a top view of the valve assembly of FIG. 1.

The valve assembly mounted in the head of an internal combustion engine is shown in perspective view in FIG. 1 and indicated generally by reference character 10. The valve assembly is mounted in the head 11 of an internal combustion engine and the head includes a conventional valve seat 12, an intake port 13 and a threaded opening 14 for a spark plug 15. Valve assembly 10 has a rocker arm comprising first and second rocker arm halves 16 and 17 which are pivotally held to head 11 by a nut 19 which holds trunion 18 by way of a stud 21 against a rocker arm mount 20. Trunion 18 provides a rocker arm to hold bearing means.

Rocker arm halves 16 and 17 are caused to oscillate by the turning of two different cams. The rocker arms are affixed to the valve rod and pushrods by trunions 22 and 23. A cam follower 24 is held on bearings 25 and 25' preferably by a plurality of needle bearings so that it is free to rotate about bearing 25. Cam follower 24 rides along the surface of cam 26 which moves the cam follower end 27 and 28 of rocker arm halves 16 and 17 in a downwardly direction thereby closing the valve. The valve ends of the rocker arms are identified by reference characters 53 and 54. Conversely, when the cam follower 24 reaches the portion of the cam indicated by reference character 29, it is permitted to move upwardly, but this upward motion is brought about in a positive manner by the upward movement of a pushrod 30 caused by the turning of a second cam 31 as it abuts cam follower 32. Thus the oscillation of rocker arm halves 16 and 17 is a positive one not relying upon the action of a valve spring.

Figure 3:
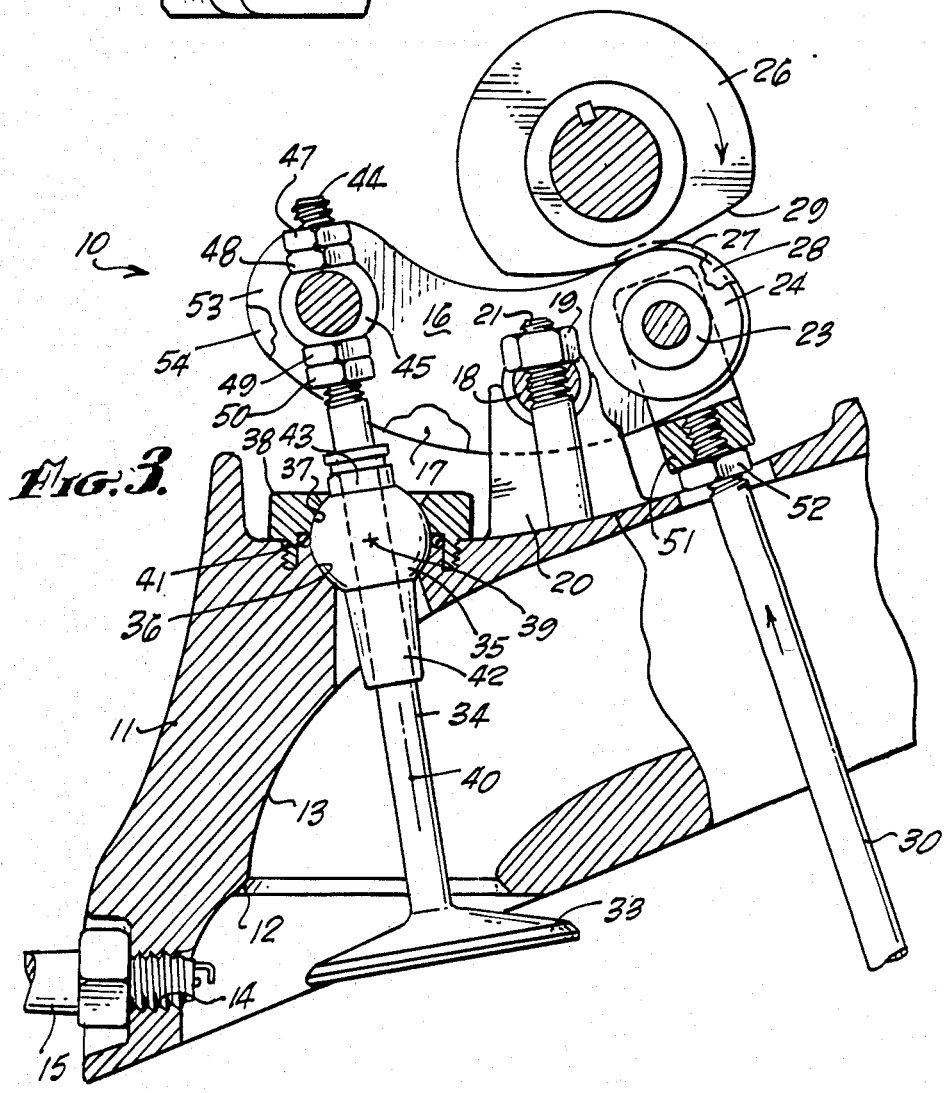
FIG. 3 is a cross-sectional side view of the valve assembly of FIG. 1 showing the valve in an open position.

The movement of the valve face 33 away from valve seat 12 is shown by comparing FIGS. 2 and 3, and it can be seen in FIG. 3 that the valve face 33 has moved sidewardly as well as downwardly with respect to valve seat 12 providing an exceptionally large passageway for gasses. This desirable movement is the result of the support of valve stem 34 in a spherical valve guide 35. Valve guide 35 is held in a spherical cavity 36 in head 11 and also in a spherical opening 37 in retainer ring 38. This permits the oscillating of valve guide 35 about a central axis 39 which passes through the center of spherical valve guide 35. The longitudinal axis 40 of valve stem 34 also passes through the center of the spherical valve guide 35 at all points of movement. Thus, the axis 39, being fixed, and the upper end of the valve stem moving through an arcuate movement with respect to the center of movement of yoke member 18, the resulting movement of the valve face is nonlinear.

The spherical valve guide 35 may be fabricated from beryllium copper, bronze, cast iron or other material having good wear characteristics. Similarly, the retainer ring 38 should be made of a material having excellent wear characteristics. Also, an O-ring 41 may be provided to increase the resistance to gas leakage about the exterior of valve guide 35. O-ring 41 may be fabricated from neoprene or other material having good wear characteristics and also resistance to high temperature. Spherical valve guide 35 has a downwardly extending sleeve 42 and an upwardly extending sleeve 43 which may be integral with valve guide 35 or a separate part. The valve stem 34, of course, moves upwardly and downwardly through sleeves 42 and 43 as well as through valve guide 35.

The upper end 44 of valve stem 34 is threaded for attachment to the trunion 22 in rocker arm halves 16 and 17. Two pairs of nuts 47, 48 and 49, 50 permit the adjustment of the valve so that it seats properly. Alternatively, two lock nuts could be used in place of these two pairs of nuts. Also, a yoke 51 is adjustably held to pushrod 30 by nut 52. The distance between the center of movement of the cam follower bearing 25 and the center of movement of trunion 23 is preferably about twice that of the distance between the center of movement of trunion 23 and the axis of movement of bearings 46 and 46'. In this way, the motion of the valve is twice that of the cam follower.

An alternate configuration of the swing valve of the present invention is shown in FIGS. 9 through 10. In this configuration, a rocker arm 60 has a pair of yokes 61 and 62. Yoke 60 holds trunion 63 and yoke 62 holds rotatable cam follower 64. A three-lobed cam, indicated generally by reference character 65, rotates about shaft 66. Cams 67 and 68 abut rollers 69 and 70 which rotate about yokes 61. Cam 71, also integral with shaft 66, abuts rotatable cam follower 64 which is held in yoke 62. Rocker arm 60 pivots about pivot pin 72 which is affixed to the head of the engine.

A still further embodiment is shown in FIGS. 6, 7 and 8 where the rocker arm is made from two halves and each half is, in turn, made from two adjacent parts. That is, referring to FIG. 7, one side of the rocker arm has a valve portion 73 and a cam follower portion 74. The other side of the rocker arm has a valve portion 75 and a cam follower portion 76. Portions 73 and 74 and 75 and 76 are adjustably held together by a pair of screws 77 and 78 and the narrowed end portions 79 and 80 are slotted and separated by a pair of sleeves 81 and 82 so that the top of valve stem 34 can be accurately aligned with valve seat 12. An additional aligning feature is also provided by an off-centered bearing mount 83 and 84, each off-centered or eccentric bearing mount being held by a pair of set screws 85. By loosening the set screws, the off-centered bearing mount may be turned to further align valve stem 34 so that the valve face 33 accurately meets valve seat 12.

In the configuration of FIGS. 6 through 8, valve stem 34 is held in a slideable mount 86 which is held in a cylinder 87 in head 11. A cylindrical pin 88 is held in slideable mount 86 by nut 89 and this permits the swinging movement of valve stem 34 which is analogous to the movement shown in comparing FIGS. 2 and 3. The cam follower portions 74 and 76 are separated by a cam follower member 90 which is held to pushrod 30 by a nut 91 which locks the threaded end of pushrod 30 into the base of cam follower member 90. A set screw 92 holds the bearing within cam follower member 90. Cam follower member 90 abuts cam 93 which is keyed to shaft 94 by a key 95. The cam follower portions 74 and 76 are held to the block through a bearing indicated generally by reference character 96.

In operation, the downward movement of valve face 33 is caused by the upward movement of pushrod 30 caused by a cam below it, not shown in FIG. 6. This moves the upper end 44 of the valve stem 34 forwardly and downwardly which, in turn, opens the valve face in a swinging motion similar to that shown in FIG. 3. The slideable mount 86 moves downwardly within cylinder 87. A certain amount of play is provided between the upper end 44 of valve stem 34 and the trunion 97. This is caused by the mounting of a sleeve 98 which is tightly held around valve stem 34 by a pair of lock nuts 99 and 100. This provides a small amount of play to take care of any expansion of the parts during the warming of the engine.

Although the valve guide is shown as a spherical valve guide, it could instead be partly cylindrical since the axis of movement 39 is constant. Also, of course, the rocker arm need not have two rocker arm halves but instead could be a single rocker arm with the various elements connected in alternate methods such as the use of the yokes.

Thus the assembly of the present invention provides excellent movement of intake and exhaust gasses because the valve moves away from rather than just downwardly from the valve seat. Also, the valve assembly of the present invention permits very rapid upward movement of the valve which is not decreased by inertia because of the positive upward drive of the valve.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A valve assembly mounted in the head of an internal combustion engine including a valve and valve support and opening and closing apparatus comprising:

an engine head including at least one valve seat;

a rocker arm held to the head by rocker arm to head bearing means, said rocker arm having a valve end and a cam follower end;

an engine valve having a valve face, a stem, a valve end and a stem end, said valve being supported along its stem by a valve guide which permits the non-axial movement of the valve stem while having a fixed point of movement with which the longitudinal axis of the valve stem always intersects, and said engine valve being affixed to said rocker arm by affixed to the valve stem, which bearing means rocker arm to valve bearing means moves in an arcuate motion about the center of movement of the rocker arm to head bearing means thereby moving the valve stem in a non-axial movement so that the longitudinal axis of the valve stem changes its angle with respect to the vertical as the valve opens and closes; and means for oscillating the rocker arm about the rocker arm to head bearing means whereby the valve face moves downwardly and sidewardly away from the valve seat as the valve end of the rocker arm moves downwardly and returns to its closed, seated position as the valve end of the rocker arm moves to its uppermost position.

2. The valve assembly of claim 1 wherein the valve stem is affixed to the rocker arm to valve bearing near the stem end of the valve.

3. The valve assembly of claim 1 wherein the means for oscillating the rocker arm about the rocker arm to head bearing means comprises a cam and cam follower means including a cam follower affixed to said rocker arm between the cam follower end of the rocker arm and the rocker arm to head bearing means.

4. The valve assembly of claim 3 wherein the cam follower of the rocker arm is driven upwardly by a first cam and downwardly by a second cam.

5. The valve assembly of claim 4 wherein the second cam is held by the head of the engine.

6. The valve assembly of claim 4 wherein the first cam drives the cam follower of the rocker arm through a pushrod.

7. The valve assembly of claim 2 wherein the valve guide includes a spherical member having a cylindrical opening having its longitudinal axis passing through the center of the spherical member and said spherical member being pivotally held by said head.

8. The valve assembly of claim 7 wherein said spherical member further includes a downwardly extending collar surrounding a portion of the valve stem below the spherical member.

9. The valve assembly of claim 7 wherein said spherical member further includes an upwardly extending collar surrounding a portion of the valve stem above the spherical member.

10. The valve assembly of claim 7 wherein the spherical member is held to the head by a retainer ring having a spherical opening therein and a spherical cavity in the head.

11. The valve assembly of claim 10 further including an O-ring at the intersection of the spherical opening in the retainer ring and the spherical cavity in the head.

12. The valve assembly of claim 3 wherein the cam follower is a roller cam follower and the center of rotation of the roller cam follower is about one-half as far from the center of movement of the rocker arm to head bearing means as the center of movement of the rocker arm to head bearing means is to the center of movement of the rocker arm to valve bearing means.

13. The valve assembly of claim 12 wherein the cam follower end of the rocker arm is moved upwardly by a pushrod affixed to the rocker arm through a rocker arm to pushrod bearing which has the same center of movement as the roller cam follower.

14. A valve assembly mounted in the head of an internal combustion engine including a valve and valve support and opening and closing apparatus comprising:

an engine head including at least one valve seat; a rocker arm held to the head by rocker arm to head bearing means, said rocker arm having a valve end and a cam follower end;

an engine valve having a valve face, a stem, a valve end and a stem end, said valve being supported along its stem by a valve guide which permits the non-axial movement of the valve stem and said engine valve being affixed to said rocker arm by rocker arm to valve bearing means affixed to the valve stem;

an upper camshaft including an upper cam held by said head, said upper cam driving a cam follower held by said rocker arm near the cam follower end thereof;

a lower camshaft including a lower cam rotatably held in a fixed position with respect to said engine head and said lower cam driving a cam follower affixed to the base of a pushrod affixed to said rocker arm at the same point of movement as the upper cam follower whereby the valve end of the rocker arm is driven upwardly by the contact of the upper cam with the cam follower and the valve end of the rocker arm is driven downwardly by the contact of the lower cam with the cam follower at the base of the pushrod.

15. The valve assembly of claim 14 wherein the rocker arm has a pair of rocker arm sides and the rocker arm to head bearing is positioned between the two sides.

16. The valve assembly of claim 15 wherein the cam follower on the rocker arm is a roller cam follower positioned between the two sides.

17. The valve assembly of claim 15 wherein the valve stem is threaded at its stem end and the valve stem extends between the two sides.

* * * * *